US006225742B1

(12) United States Patent
Iida et al.

(10) Patent No.: US 6,225,742 B1
(45) Date of Patent: May 1, 2001

(54) SELF-BALLASTED FLUORESCENT LAMP

(75) Inventors: Shiro Iida, Osaka; Tetsuya Tahara, Shiga; Hiroki Nakagawa, Osaka, all of (JP)

(73) Assignee: Matsushita Electronics Corporation, Osaka (JP)

( * ) Notice: Subject to any disclaimer, the term of this patent is extended or adjusted under 35 U.S.C. 154(b) by 0 days.

(21) Appl. No.: 09/640,423

(22) Filed: Aug. 17, 2000

(30) Foreign Application Priority Data

Aug. 27, 1999 (JP) ..... 11-241117

(51) Int. Cl.[7] ..... H01J 7/44

(52) U.S. Cl. ..... 315/56; 315/63; 313/317; 313/493

(58) Field of Search ..... 315/56, 57, 58, 315/51, 63; 313/317, 493, 318.01, 318.03, 318.04

(56) References Cited

U.S. PATENT DOCUMENTS 4,455,508 * 6/1984 Wesselink ..... 315/62

* cited by examiner

*Primary Examiner*—David Vu
(74) *Attorney, Agent, or Firm*—Merchant & Gould P.C.

(57) ABSTRACT

A high wattage self-ballasted fluorescent lamp includes a fluorescent tube including a pair of electrodes inside, an electronic ballast circuit portion, an outer bulb, a resin case and a lamp base. (i) The outer bulb has an outer diameter of 60 mm to 70 mm, an outer diameter of a bottom portion of 50 mm to 58 mm, and a total length of 73 mm to 85 mm. (ii) The resin case has an outer diameter of 50 mm to 58 mm. (iii) The total length of the self-ballasted fluorescent lamp is not more than 148 mm. The fluorescent tube has a distance between the electrodes of 450 mm to 540 mm and an inner diameter of 8.0 mm to 10.0 mm, and is operated at a lamp current of not more than 220 mA. Thus, the self-ballasted fluorescent lamp can be compact so that the light fixture application ratio can be improved. Moreover, the self-ballasted fluorescent lamp has a lifetime as long as 6000 hours and a lamp efficiency as high as 66 lm, and the power consumption can be reduced.

5 Claims, 10 Drawing Sheets

SELF-BALLASTED FLUORESCENT LAMP

BACKGROUND OF THE INVENTION

1. Technical Field

The present invention relates to a self-ballasted fluorescent lamp.

2. Background Art

For energy saving, a high efficiency self-ballasted fluorescent lamp that can replace a low efficiency incandescent lamp has been under active development and research in the lighting field.

Conventionally, three types of self-ballasted fluorescent lamps with luminous fluxes equivalent to those of 40 W, 60 W and 100 W of incandescent lamps have been developed. The lamp powers of these types are about 10 W, 14 W and 25 W, respectively, which are about ¼ of the lamp powers of the incandescent lamps. Thus, the self-ballasted fluorescent lamp can provide a large effect for energy saving. In the early stage of the development, low wattage self-ballasted fluorescent lamps with luminous fluxes equivalent to those of 40 W and 60 W incandescent lamps were subjects for development. Recently, a high wattage fluorescent lamp with a luminous flux of 1520 lm that can replace a 100 W incandescent lamp has been under development. In the development of these fluorescent lamps, in order to promote replacement of a compact incandescent lamp, it is desired to attain a high ratio of the existing light fixtures to which the self-ballasted fluorescent lamp can be applied without modifying the light fixtures (hereinafter, this ratio is referred to as "light fixture application ratio"). For this reason, the development is directed especially to achieving a small lamp shape.

FIGS. 9 and 10 show examples of the shape of a conventional self-ballasted fluorescent lamp. FIG. 9 shows a low wattage fluorescent lamp, and FIG. 10 shows a high wattage fluorescent lamp. The fluorescent lamps include fluorescent tubes 28 and 29, electronic ballast circuit portions 30 and 31, outer bulbs 32 and 33, resin cases 34 and 35, and lamp bases 36 and 37, respectively. When comparing the shape of an incandescent lamp with that of a conventional self-ballasted fluorescent lamp, in an eggplant-shaped incandescent lamp, the outer diameter of the outer bulb is 60 mm and the total length of the lamp is 110 mm, whereas the early-developed low wattage fluorescent lamp has an eggplant-shaped outer bulb 32, which is similar to the incandescent lamp shape, and is fairly compact, where the outer diameter Do of the outer bulb 32 is 60 mm, and the total length Lo of the lamp is 130 mm. Therefore, the light fixture application ratio is as high as about 70%.

On the other hand, it is desired to attain a high light fixture application ratio by producing a further compact high wattage self-ballasted fluorescent lamp (of a conventional lamp power of about 25 W) that can replace the 100 W incandescent lamp, whose replacement is particularly effective for energy saving in the development of the self-ballasted fluorescent lamp replacing the incandescent lamp.

However, regarding the high wattage self-ballasted fluorescent lamp replacing the 100 W incandescent lamp, the outer bulb 33 is cylindrical, as shown in FIG. 10, the outer diameter Do is about 70 mm, and the total length Lo of the lamp is about 150 mm. This is insufficient in terms of compactness, and therefore, the light fixture application ratio is as low as about 40%.

Prior to the development of such a high wattage self-ballasted fluorescent lamp, the inventors of the present invention first examined the shape and the size of various light fixtures for incandescent lamps to specify requirements from the aspect of lamp shape to improve the light fixture application ratio of the lamp. The following requirements are the outcome of this examination.

(i) The outer bulb should have an eggplant shape similar to an incandescent lamp, as shown in FIG. 9, and a narrowed outer diameter at its bottom portion.

(ii) In addition, the outer diameter of the resin case also should be narrowed.

When these requirements are satisfied, the shoulder of the resin case can be prevented from contacting a reflection plate of the light fixture, which occurred in a conventional high wattage self-ballasted fluorescent lamp, and the light fixture application ratio can be improved. On the other hand, regarding the total length of the lamp, even if it is relatively large, it can be applied to an open type light fixture. However, it is necessary to attain good appearance of the light fixture on which the lamp is mounted. Therefore, it is desired at least to achieve a size not larger than that of the conventional high wattage self-ballasted fluorescent lamp.

It is concluded that when the following requirements are satisfied for the upper limits of the sizes in various portions of the high wattage self-ballasted fluorescent lamp, the light fixture application ratio of the lamp can be raised to about 70%, which is equivalent to that in the case of the low wattage self-ballasted fluorescent lamp.

(i) The outer diameter Do of the eggplant-shaped outer bulb 32 is 70 mm, the outer diameter Di of the bottom portion is 58 mm, and the total length Li is 85 mm.

(ii) The outer diameter Dc of the resin case is 58 mm.

(iii) The total length Lo of the lamp is 148 mm.

The lower limit of the lamp size can be defined under the conditions in which predetermined rated values of the characteristics of the lamp including the lifetime can be obtained as described later.

Next, as a preliminary development, the inventors of the present invention measured the characteristics of the lamp including the lifetime with a smaller high wattage self-ballasted fluorescent lamp having the above-described lamp size As a result, it turned out that a first problem in the development of the high wattage self-ballasted fluorescent lamp with a lamp power of about 25 W is that the lifetime of the lamp is short. This is caused primarily by (i) a high level of deterioration of the luminous flux during the lifetime of the lamp due to an excessive increase in the temperature of the fluorescent tube and (ii) occurrence of malfunction of the circuit due to an excessive increase in the temperature of the electronic components of the electronic ballast circuit portion and the PC resin substrate mounted in the narrow resin case.

In particular, the reduction of the lifetime of the lamp due to the factor (ii) is often caused by malfunction of a capacitor component, which terminates the lifetime of the lamp in a relatively short time. In order for a compact high wattage self-ballasted fluorescent lamp replacing the 100 W incandescent lamp to be used widely, it is necessary to ensure 6000 hours or more lifetime, which is equivalent to that of the conventional lamp.

Furthermore, a high efficiency and high wattage self-ballasted fluorescent lamp that consumes power less than about 25 W of the conventional lamp is desired for further energy saving. Desired target values are 23 W or less for the lamp power and 66 lm/W or more for the luminous efficiency of the lamp in order to attain a luminous flux of 1520 lm equivalent to that of the 100 W incandescent lamp.

SUMMARY OF THE INVENTION

Therefore, with the foregoing in mind, it is an object of the present invention to provide a high efficiency and high wattage self-ballasted fluorescent lamp whose light fixture application ratio is improved by achieving a further compact lamp shape, and that has a lamp lifetime of 6000 hours or more and consumes less power.

A self-ballasted fluorescent lamp of the present invention includes a fluorescent tube including a pair of electrodes inside, an electronic ballast circuit portion, an outer bulb, a resin case and a lamp base. (i) The outer bulb has an outer diameter of 60 mm to 70 mm, an outer diameter of a bottom portion of 50 mm to 58 mm, and a total length of 73 mm to 85 mm. (ii) The resin case has an outer diameter of 50 mm to 58 mm. (iii) The total length of the self-ballasted fluorescent lamp is not more than 148 mm. The fluorescent tube has a distance between the electrodes of 450 mm to 540 mm and an inner diameter of 8.0 mm to 10.0 mm, and is operated at a lamp current of not more than 220 mA.

Thus, the self-ballasted fluorescent lamp can be compact so that the light fixture application ratio can be improved to 70% or more. Moreover, the self-ballasted fluorescent lamp has a lifetime as long as 6000 hours and a lamp efficiency as high as 66 lm, so that the power consumption of the lamp can be reduced.

In one preferable embodiment of the self-ballasted fluorescent lamp, a distance between the electrodes of the fluorescent tube and a PC resin substrate of the electronic ballast circuit portion is 25 mm to 40 mm.

This embodiment prevents an excessive increase in the temperature, especially of the electronic components and the PC resin substrate, so that malfunction of the circuit or the like can be prevented and the lifetime of 6000 hours or more can be ensured.

In another preferable embodiment of the self-ballasted fluorescent lamp, a buffer gas enclosed in the fluorescent tube is based on a mixed gas of Ne and Ar, where a composition ratio of Ne is not more than 75%.

This embodiment allows even higher lamp efficiency with the same inner diameter of the tube.

In still another preferable embodiment of the self-ballasted fluorescent lamp, the fluorescent tube is obtained by integrating four U-shaped glass tubes into one tube.

This embodiment facilitates further compactness of the lamp shape and high efficiency of the lamp.

In yet another preferable embodiment, the self-ballasted fluorescent lamp is operated at a lamp current of not more than 210 mA.

This embodiment allows higher lamp efficiency and thus further reduction of the power consumption of the lamp.

These and other advantages of the present invention will become apparent to those skilled in the art upon reading and understanding the following detailed description with reference to the accompanying figures.

DESCRIPTION OF THE PREFERRED EMBODIMENTS

Figure 1:
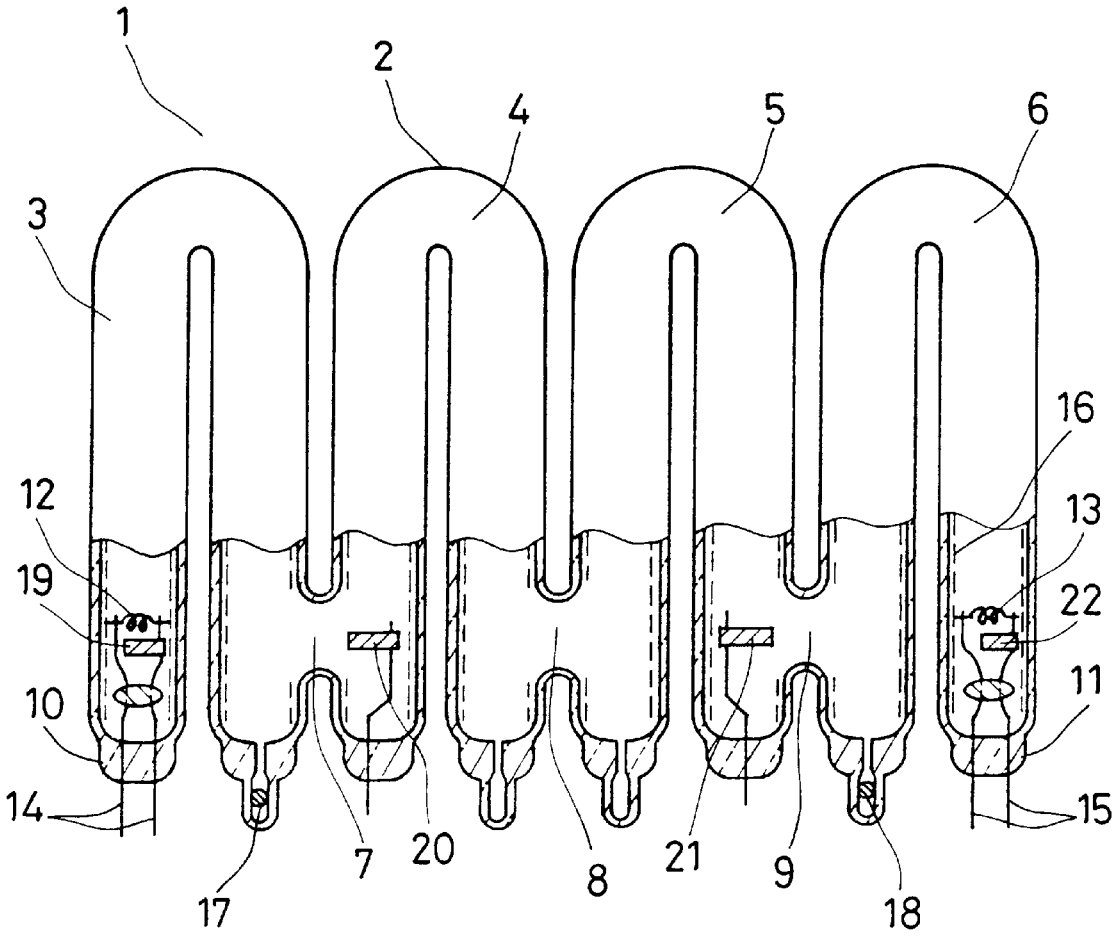
FIG. 1 is a development of a fluorescent tube of a self-ballasted fluorescent lamp of an embodiment of the present invention.
Figure 2:
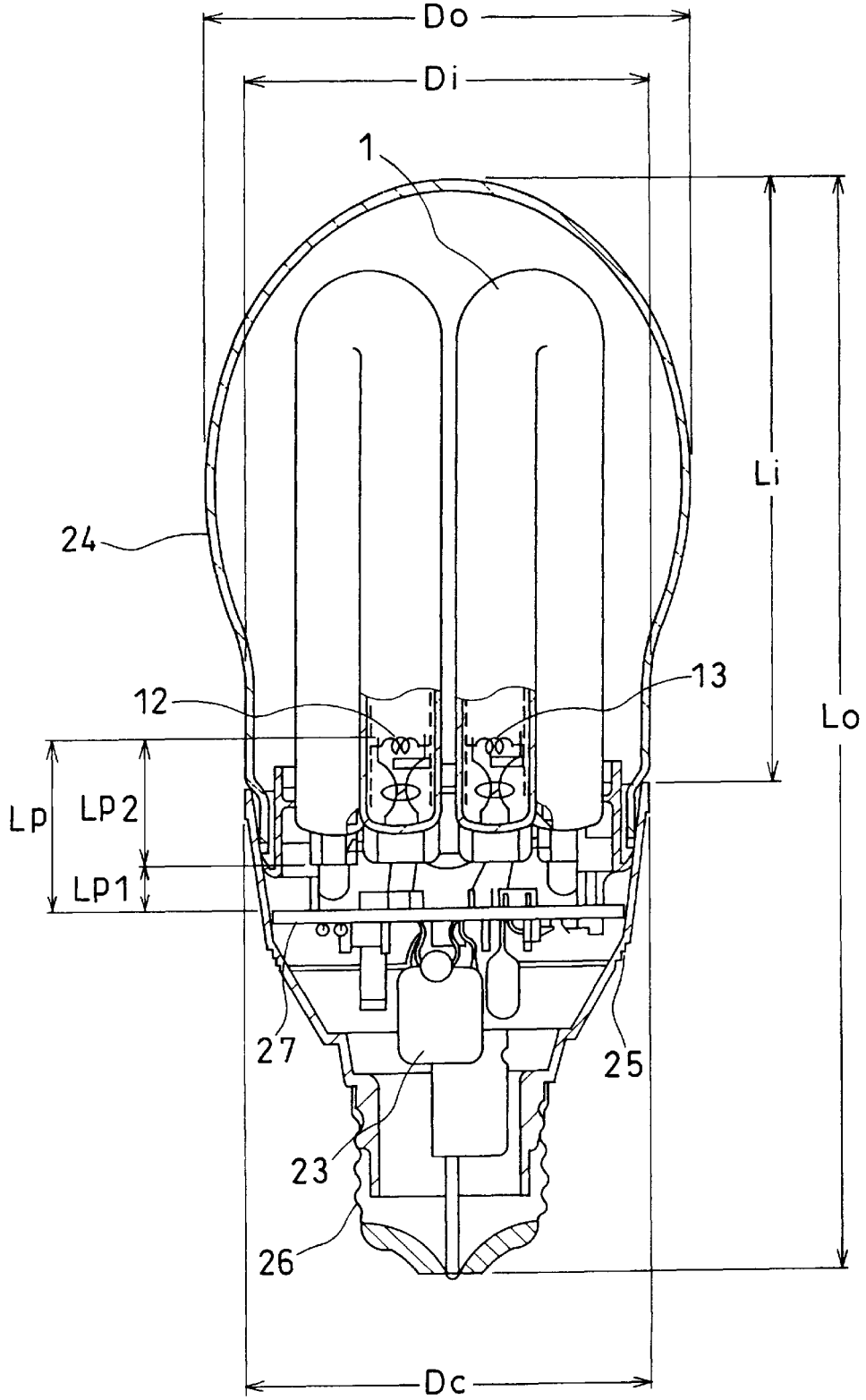
FIG. 2 is a partially cutaway front view of a self-ballasted fluorescent lamp of an embodiment of the present invention.

FIGS. 1 and 2 are a development of a luminescent tube of an embodiment of a self-ballasted fluorescent lamp of the present invention and a diagram showing the structure of a finished product of the lamp, respectively.

An envelope 2 of the fluorescent tube 1 of FIG. 1 is obtained by joining four U-shaped glass tubes 3, 4, 5 and 6 at so-called bridge injunctions 7, 8 and 9 so that a communicating discharge path is formed. A pair of tungsten coil electrodes 12 and 13 are held by lead wires 14 and 15 at the respective tube end portions 10 and 11 of the U-shaped glass tubes 3 and 6, which are the opposite ends of the discharge path. Phosphor 16 is applied to main portions of the inner surfaces of the U-shaped glass tubes 3, 4, 5 and 6. In an example of the present invention, a mixture of three types of rare earth phosphors emitting red, green and blue light, namely, $Y_2O_3$: Eu, $LaPO_4$ : Ce, Tb and $BaMg_2Al_6O_{27}$: Eu, Mn was used as the phosphor 16.

Two main amalgams 17 and 18 and four auxiliary amalgams 19, 20, 21 and 22 are placed inside the envelope 2 of the fluorescent tube 1. Further, rare gas such as argon and neon is enclosed as a buffer gas. In the example, Bi—Pb—Sn—Hg grains (total amount of 110 mg, Hg ratio of 1.5%) were used as the main amalgams 17 and 18. Stainless steel meshes plated with In were used as the auxiliary amalgams 19, 20, 21 and 22.

FIG. 2 shows a finished product of the self-ballasted fluorescent lamp. This self-ballasted fluorescent lamp is constituted by combining the fluorescent tube 1, the electronic ballast circuit portion 23, the outer bulb 24, the resin case 25 and the lamp base 26. The electronic ballast circuit portion 23 includes a plurality of electronic components mounted on the PC resin substrate 27.

The upper limits of the sizes in various portions of the lamp are set as follows: (i) The outer diameter Do of the outer bulb 24 is 70 mm, the outer diameter Di of the bottom portion of the outer bulb 24 is 58 mm, and the total length Li of the outer bulb 24 is 85 mm; (ii) The outer diameter Dc of the resin case 25 is 58 mm, and (iii) the total length Lo of the lamp is 148 mm. These values correspond to the upper limit of the size of a compact lamp that should be satisfied to achieve the light fixture application ratio of 70%, which is an object of the present invention. Furthermore, a circuit having a basic structure of a series inverter system is used as the electronic ballast circuit portion 23, and the circuit-conversion efficiency (the ratio of the power output from the circuit to the power input to the circuit) is 91%.

In the development of the desired high wattage self-ballasted fluorescent lamp, the inventors of the present invention first examined fluorescent tubes having various conventional structures in order to determine the form of the fluorescent tube to be used. As a result, it was concluded that the fluorescent tube 1 formed of four U-shaped glass tubes shown in FIG. 1 is suitable to achieve the object of the present invention in that (i) the lamp shape relatively easily can be made compact; and (ii) the discharge path between the opposite electrodes becomes long so that the luminous efficiency is improved, and the power consumption can be reduced.

Furthermore, regarding the high wattage self-ballasted fluorescent lamp using the fluorescent tube formed of four U-shaped glass tubes, the inventors of the present invention carried out research to ensure the lifetime of at least 6000 hours when the above-described compact lamp shape is adopted to improve the light fixture application ratio. As described above, the reduction in the lifetime of the lamp due to the compactness of the lamp shape is caused by the following two factors: (i) a primary factor is an increase of the deterioration of the luminous flux due to an excessive increase in the temperature of the fluorescent tube, and (ii) a secondary factor is malfunction of the circuit due to an excessive increase in the temperature of the electronic components of the electronic ballast circuit portion and the PC resin substrate. Therefore, research was carried out to suppress such increases in the temperature. As a result, the following is found out.

(a) The primary parameter that defines the temperature of the fluorescent tube, the electronic components of the electronic ballast circuit portion and the PC resin substrate is the extent of heat release of the fluorescent tube 1 provided inside the outer bulb 24. The fluorescent tube of a regular self-ballasted fluorescent tube consumes about 90% of the power consumption of the lamp, and about 75% of the power consumed in the fluorescent tube is released as heat. Therefore, the extent of heat release of the fluorescent tube depends basically on the lamp power, so that the increase of the extent of heat release is inevitable in fluorescent lamps of high wattage such as about 25 W. Furthermore, as described later, the temperature of the electronic ballast circuit portion depends significantly on the extent of heat release of a pair of electrode end portions that are provided close to this circuit and have a high ratio of power consumption.

(b) The secondary parameter that defines the temperature of the electronic components and the PC resin substrate is a so-called circuit loss, that is, a power consumption of the electronic ballast circuit portion itself. In this case, basically, such a circuit loss depends more on the lamp current rather than on the lamp power. The circuit loss is decreased by reducing the lamp current, so that the temperature of the electronic components and the PC resin substrate is reduced. However, in recent years, the circuit loss of the electronic ballast circuit portion has been reduced gradually by (i) development of improved designs for electronic circuits, (ii) reduction of the loss of the electronic components, and the like. At present, the circuit loss has been reduced to the minimum limit range of slightly less than 10% of the power consumption of the lamp. Therefore, further reduction in the circuit loss may be difficult.

In conclusion, as a basic method for suppressing excessive increase in the temperature of the electronic components and the PC resin substrate, suppressing the extent of heat release of the fluorescent tube is primarily advantageous.

Regarding the high wattage self-ballasted fluorescent lamp using the fluorescent tube 1 shown in FIG. 1, in order to suppress the extent of heat release of the fluorescent tube 1, first, the power consumption of the fluorescent tube 1 itself should be suppressed. This means improving the luminous efficiency of the fluorescent tube 1, namely, the lamp, and thus this corresponds to another object of the present invention, that is, further reduction of the power consumption of the lamp for energy saving.

The high wattage self-ballasted fluorescent lamp with a luminous flux of 1520 lm, to which the present invention is directed, should be made more compact in lamp shape, as described above. The inner diameter of the fluorescent tube 1 to be used should be about 10.5 mm smaller than that of a conventional lamp. In this case, the inventors of the present invention estimated that the primary parameter that influences the luminous efficiency of such a lamp is the lamp current. More specifically, when the inner diameter of the tube becomes smaller and the lamp current density becomes high, the saturation characteristics of the luminous flux of the fluorescent tube 1 becomes significant with respect to the increase of the lamp current. Therefore, the lamp efficiency is reduced with increasing lamp current. Thus, at first, experiments were carried out to define a range of a lamp current that achieves the lamp efficiency of 66 lm/W or more, which is an object of the present invention, and then, to specify suitable ranges of various relevant parameters of the fluorescent tube 1.

More specifically, at first, the lamp efficiency and the lifetime characteristics were measured while varying the inner diameter that influences the lamp current and keeping the distance Le between the electrodes of the fluorescent tube 1 constant. In this measurement, as a typical lamp that sufficiently can satisfy a light fixture application ratio of 70%, which is an object of the present invention, a lamp having the following lamp size was used: (i) 65 mm for the outer diameter Do of an eggplant-shaped outer bulb 24, 54 mm for the outer diameter Di of the bottom portion thereof, and 79 mm for its total length Li; (ii) 54 mm for the outer diameter Dc of the resin case 25, and (iii) 143 mm for the total length Lo of the lamp, which values are smaller than the upper limits described above. The distance Le between the electrodes of the fluorescent tube 1 was set at 490 mm, which is suitable for the above-described lamp size. A standard Ar gas was enclosed at 3 Torr as a rare gas, which is a buffer gas. Then, the measurement revealed the following.

Figure 3:
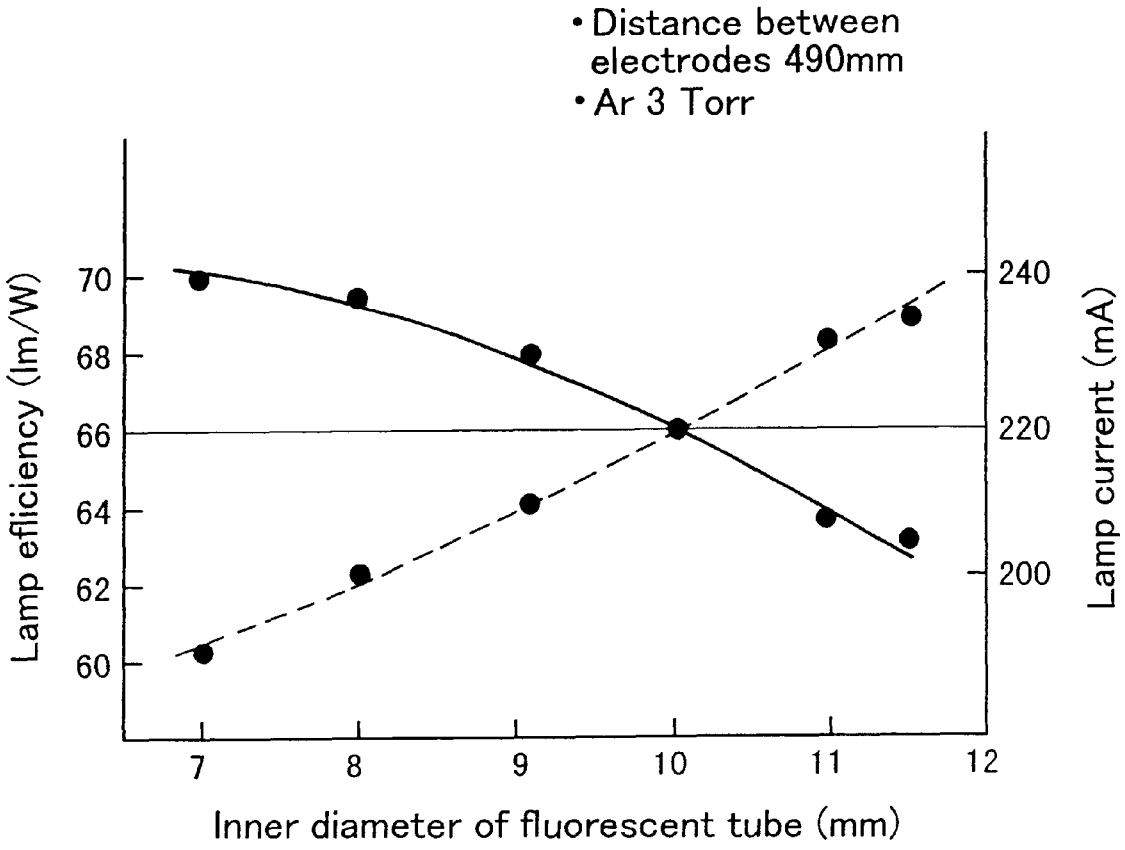
FIG. 3 is a graph showing the relationship between the inner diameter of the fluorescent tube and the characteristics of the lamp.

(a) As shown in FIG. 3, as the inner diameter of the fluorescent tube 1 becomes smaller, the lamp current (shown by the broken line in FIG. 3) is monotonically decreasing, and the lamp efficiency (shown by the solid line in FIG. 3) increases. Thus, the lamp power that provides a luminous flux of 1520 lm becomes lower. In order to achieve the lamp efficiency of 66 lm/W or more, which is an object of the present invention, the inner diameter of the lamp is in the range of not more than 10.0 mm, which corresponds to a range of not more than 220 mA of the lamp current. In such a range, even if the lamp power is 23 W or less, which is lower than the conventional value of about 25 W, a lamp having a luminous flux of about 1520 lm can be obtained. Furthermore, a more preferable lamp current is in a range of not more than 210 mA. In this case, for example, when the lamp power is 22 W, the lamp efficiency is 68 lm/W , and a lamp having a luminous flux of nearly 1520 lm, which is desired, can be obtained.

Figure 4:
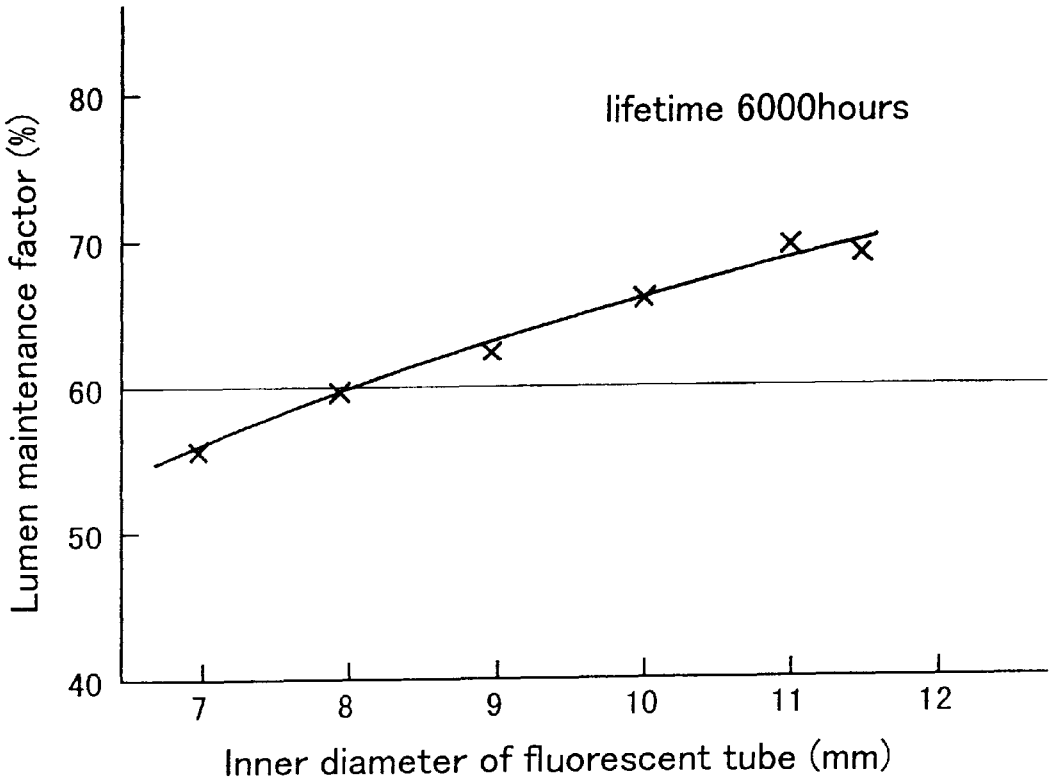
FIG. 4 is a graph showing the relationship between the inner diameter of the fluorescent tube and the lumen maintenance factor of the lamp.

(b) FIG. 4 shows the lumen maintenance factor at the lifetime of 6000 hours of the lamp (a percentage of the luminous flux at 6000 hours lighting to the luminous flux at 100 hours lighting), with varied inner diameters as shown in FIG. 3. Since it is defined that the lifetime of the self-ballasted fluorescent lamp ends when the lumen maintenance factor reaches 60%, it is necessary to set the inner diameter of the lamp in a range of not less than 8.0 mm in order to ensure the lifetime of 6000 hours, which is an object of the present invention. When the inner diameter is less than 8.0 mm, the load to the wall of the fluorescent tube 1 becomes high, so that the temperature of the tube wall is excessively high and the luminous flux deterioration of the phosphor 16 becomes large.

Next, research was carried out to determine the range of the distance Le between the electrodes of the fluorescent tube 1. In the present invention, the upper limit of the distance Le between the electrodes corresponds to the longest distance in the range that allows the fluorescent tube 1 having an inner diameter of not more than 10.0 mm to be provided inside the outer bulb 24 having the upper limit in size (70 mm for the outer diameter Do, 58 mm for the outer diameter Di of the bottom portion, and 85 mm for the total length Li). This research revealed that the upper limit of the distance Le between the electrodes can be defined as 540 mm.

Then, in order to define the lower limit of the distance Le between the electrodes, the lamp characteristics including the lifetime were measured with lamps with varied Le values in each case where the inner diameter is the lower limit of 8.0 mm and the upper limit of 10.0 mm. The same standard Ar gas as above was enclosed at 3 Torr as a buffer gas.

Figure 5:
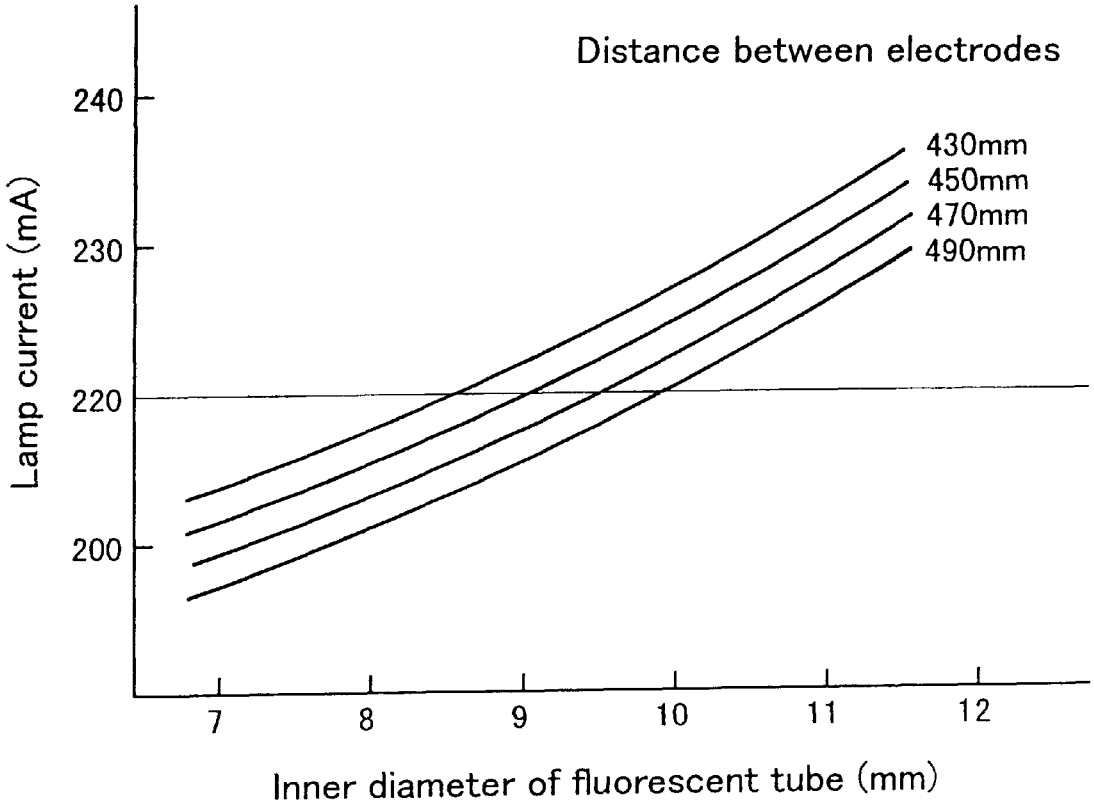
FIG. 5 is a graph showing the relationship between the inner diameter of the fluorescent tube and the current of the lamp with the distance between the electrodes as the parameter.
Figure 6:
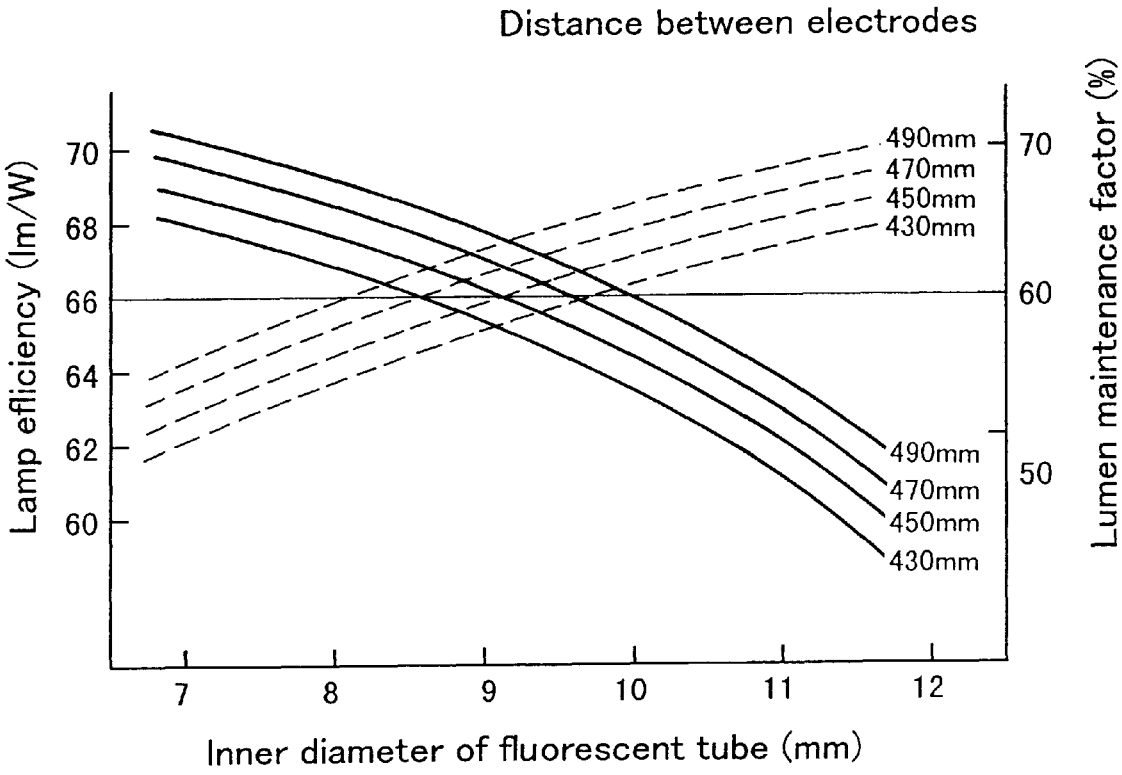
FIG. 6 is a graph showing the relationship between the inner diameter of the fluorescent tube and the lumen maintenance factor of the lamp with the distance between the electrodes as the parameter.

The measurement revealed the following, as shown in FIGS. 5 and 6.

(i) The shorter the distance Le between the electrodes is, the larger the lamp current is, regardless of the inner diameter, and therefore (ii) both the lamp efficiency (shown by the solid lines in FIG. 6) and the lumen maintenance factor (shown by the broken lines in FIG. 6) at the lifetime of 6000 hours are decreased. When the distance Le between the electrodes is in a range of not more than 450 mm, the targeted lamp efficiency of 66 lm/W and lifetime of 6000 hours cannot be achieved at the same time.

In conclusion, it is apparent that a first approach for suppressing the extent of heat release of the fluorescent tube to obtain a high wattage self-ballasted fluorescent lamp desired by the present invention is to set (i) the distance Le between the electrodes in the fluorescent tube at 450 mm to 540 mm, the inner diameter of the tube at 8.0 mm to 10.0 mm, and (ii) the lamp current in a range of not more than 220 mA.

Figure 7:
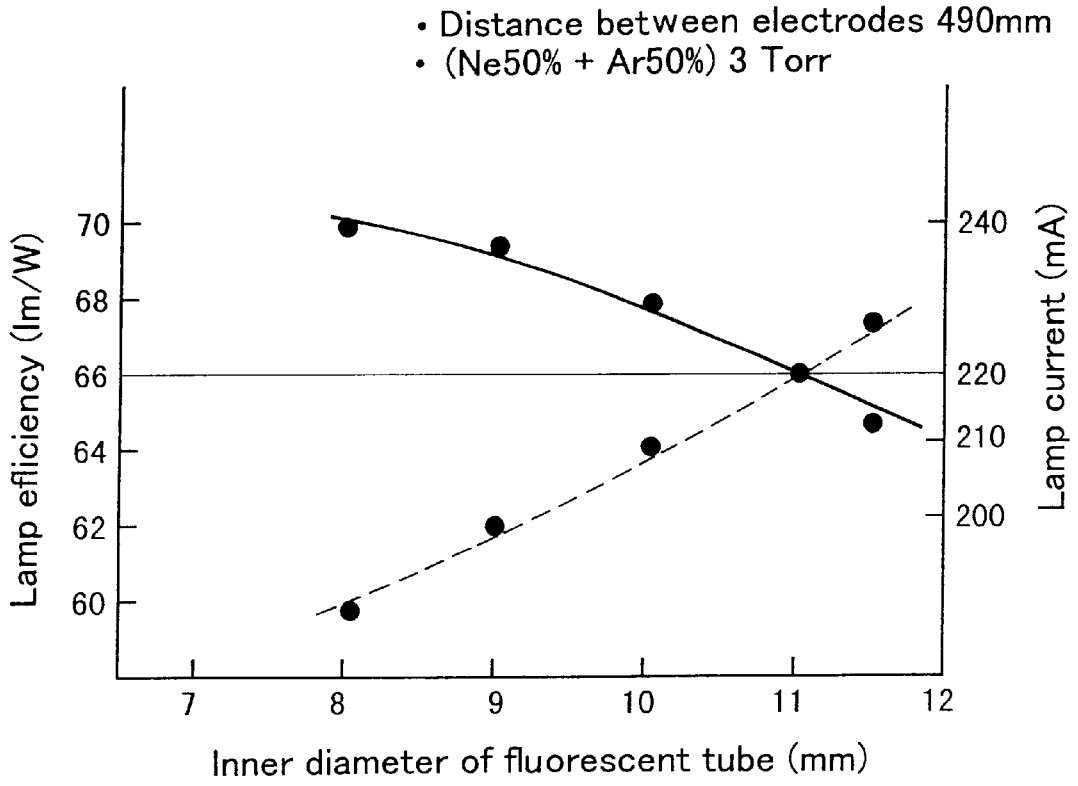
FIG. 7 is a graph showing changes in the lamp characteristics with a (Ne+Ar) buffer gas in the fluorescent tube.

Furthermore, changes in the lamp characteristics by the type of buffer gas were examined with a lamp where a mixed gas (Ne 50%+Ar 50%) was enclosed instead of the standard Ar gas as the buffer gas. This examination revealed that, as shown in FIG. 7, in a lamp enclosing the mixed gas (Ne 50%+Ar 50%) at 3 Torr, the lamp current (shown by the broken line in FIG. 7) is lower, and the lamp efficiency (shown by the solid line in FIG. 7) is larger than that of a lamp enclosing Ar gas with the same inner diameter of the tube. For example, at the upper limit of the inner diameter of the tube of 10.0 mm, the lamp current was about 210 mA, and the lamp efficiency was about 68 lm/W. Regarding the lamp lifetime characteristics, although the lamp current decreased with the same inner diameter of the tube, the lifetime characteristics were such that the lumen maintenance factor substantially was equal to that of the lamp enclosing Ar gas of FIG. 4. However, with a lamp enclosing Ne at a mixture ratio of 75% or more, the emissive material filled in the tungsten coil electrodes 12 and 13 wear significantly during the lifetime, so that the lifetime of 6000 hours cannot be ensured.

Thus, it is apparent that in the high wattage self-ballasted fluorescent lamp targeted by the present invention, using a (Ne+Ar) mixed gas is advantageous for further improvement of the lamp efficiency with the same inner diameter of the tube.

As described above, a combination of the upper limit of 10.0 mm of the inner diameter of the fluorescent tube 1 and the upper limit of 540 mm of the distance Le between the electrodes corresponds to the upper limit size of the outer bulb 24, namely, 70 mm for the outer diameter Do, 58 mm for the outer diameter Di of the bottom portion and 85 mm for the total length Li. The lower limit size of the outer bulb 24 corresponds to a combination of 9.3 mm for the inner diameter of the fluorescent tube 1 and 450 mm for the distance Le between the electrodes. Therefore, it was found that the lower limit values of the size of the outer bulb 24 are 60 mm for the outer diameter Do, 50 mm for the outer diameter Di of the bottom portion and 73 mm for the total length Li. In conclusion, a suitable size of the lamp is in the range of (i) as the size of the outer bulb 24, 60 mm to 70 mm for the outer diameter Do, 50 mm to 58 mm for the outer diameter Di of the bottom portion and 73 mm to 85 mm for the total length Li, (ii) 50 mm to 58 mm for the outer diameter Dc of the resin case 25, and (iii) 148 mm or less for the total length Lo of the lamp. A suitable size of the fluorescent tube 1 is such that the distance Le between the electrodes is in the range of 450 mm to 540 mm, and the inner diameter of the tube is in the range of 8.0 mm to 10.0 mm.

In the above, the reduction of the power consumption itself has been examined in order to suppress the extent of heat release of the phosphor luminescent lamp that defines the temperature of the electronic components of the electronic ballast circuit portion 23 and the PC resin substrate 27. On the other hand, as described above, in the self-ballasted fluorescent lamp having a structure shown in FIG. 2, the heat release from a pair of electrode portions of the fluorescent tube 1 facilitates the increase in the temperature of the electronic components of the electronic ballast circuit portion 23 and the PC resin substrate 27. This is one factor that causes the lifetime of the lamp to be shortened.

Research was carried out for a specific approach for suppressing the increase in the temperature of the electronic components and the PC resin substrate 27 due to the heat release from the electrode portions. In this case, it is defined as a specific standard value in the lamp development regarding the temperature of the electronic components and the PC resin substrate 27 that the maximum temperature of the PC resin substrate 27 during lamp lighting is not more than 130° C. When this standard value is satisfied, the targeted lifetime of 6000 hours or more of the electronic circuit can be ensured. In this experiment, as a typical lamp based on the above results that achieves the objects of the present invention, a lamp having the following lamp size was used: (i) 65 mm for the outer diameter Do of the outer bulb 24, 54 mm for the outer diameter Di of the bottom portion and 79 mm for the total length Li, (ii) 54 mm for the outer diameter Dc of the resin case 25, and (iii) 143 mm for the total length Lo of the lamp. The size of the fluorescent tube 1 is such that the distance Le between the electrodes is 490 mm and the inner diameter of the tube is 9.1 mm. The lamp was operated at a lamp current of 210 mA and exhibited the characteristic that the lamp efficiency was 68 lm/W at a lamp power of 22 W.

This research revealed that one primary parameter that influences the temperature of the PC resin substrate 27 is the distance Lp between the pair of tungsten coil electrodes 12 and 13 of the fluorescent tube 1 and the PC resin substrate 27.

Figure 8:
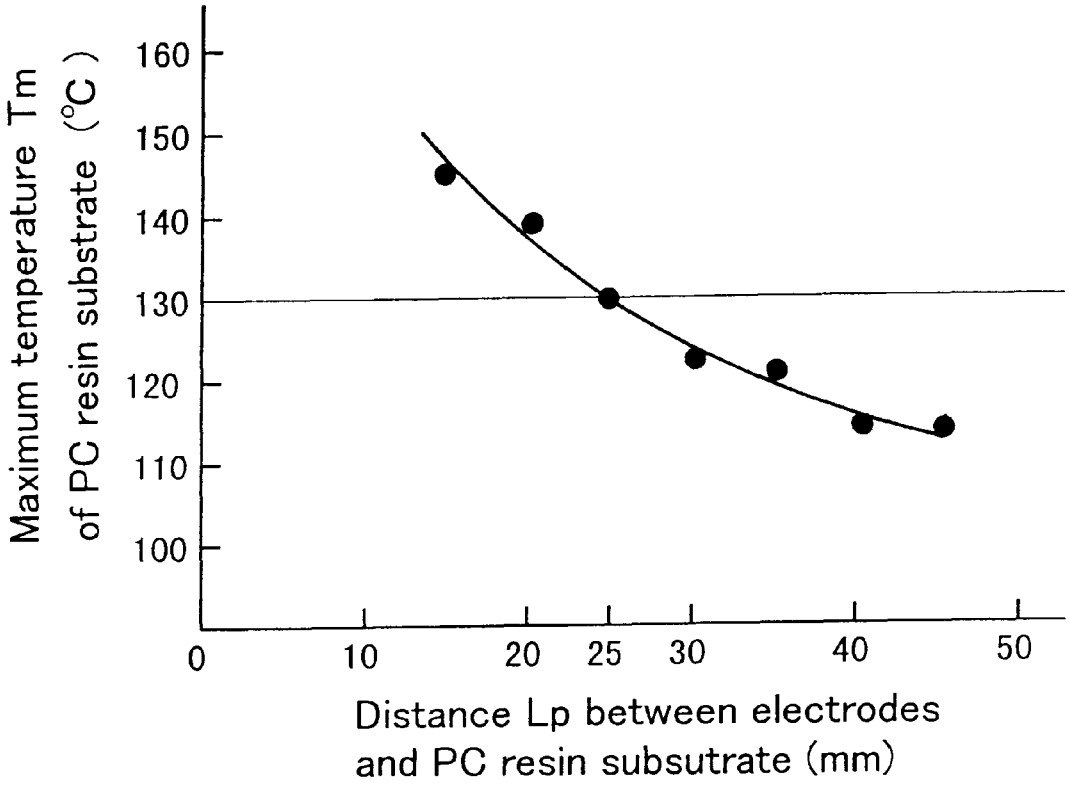
FIG. 8 is a graph showing changes in the maximum temperature of a PC resin substrate with respect to the distance Lp between the electrodes and the PC resin substrate.
Figure 9:
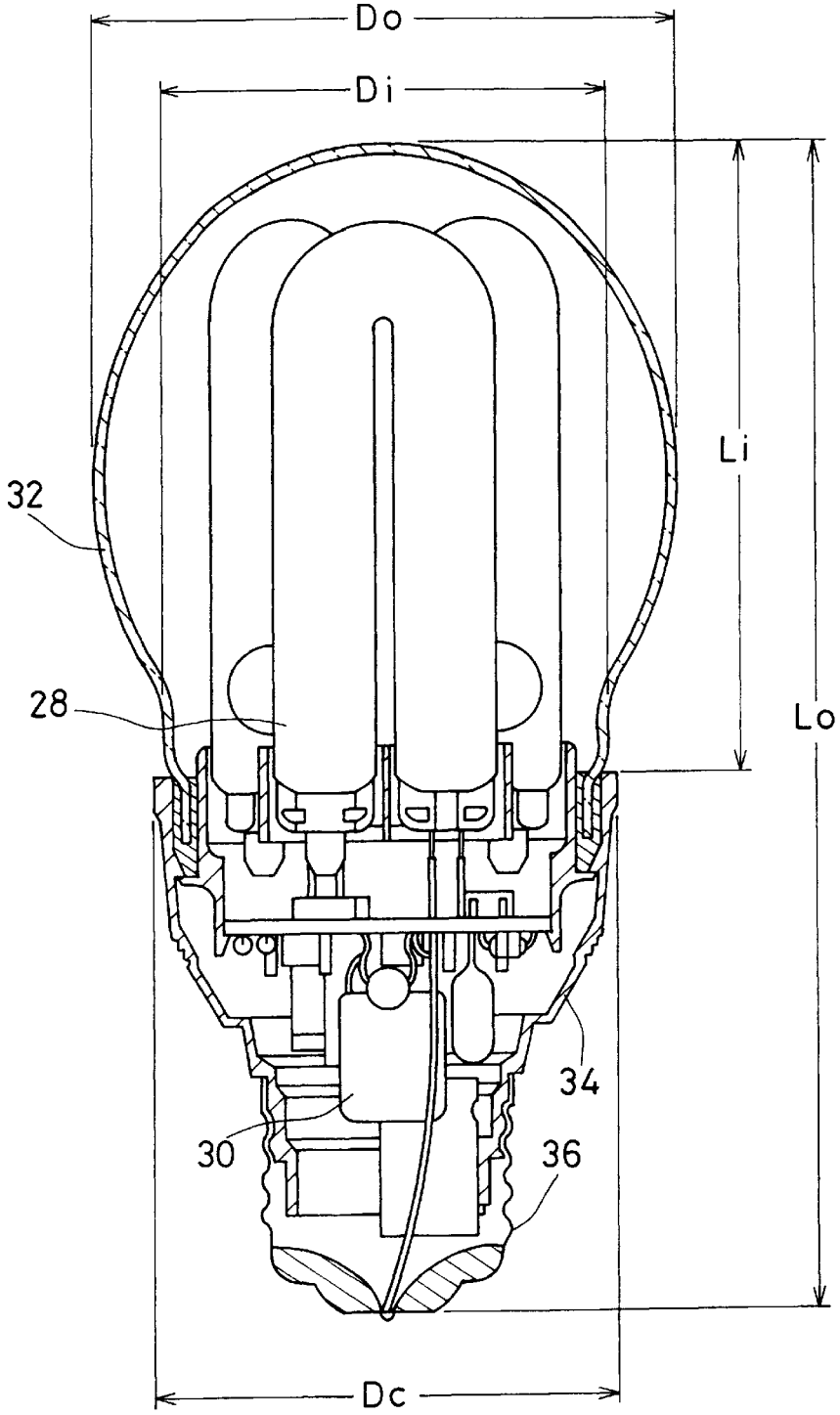
FIG. 9 (PRIOR ART)
FIG. 9 is a partially cutaway front view of a self-ballasted fluorescent lamp provided with a conventional eggplant-shaped outer bulb.
Figure 10:
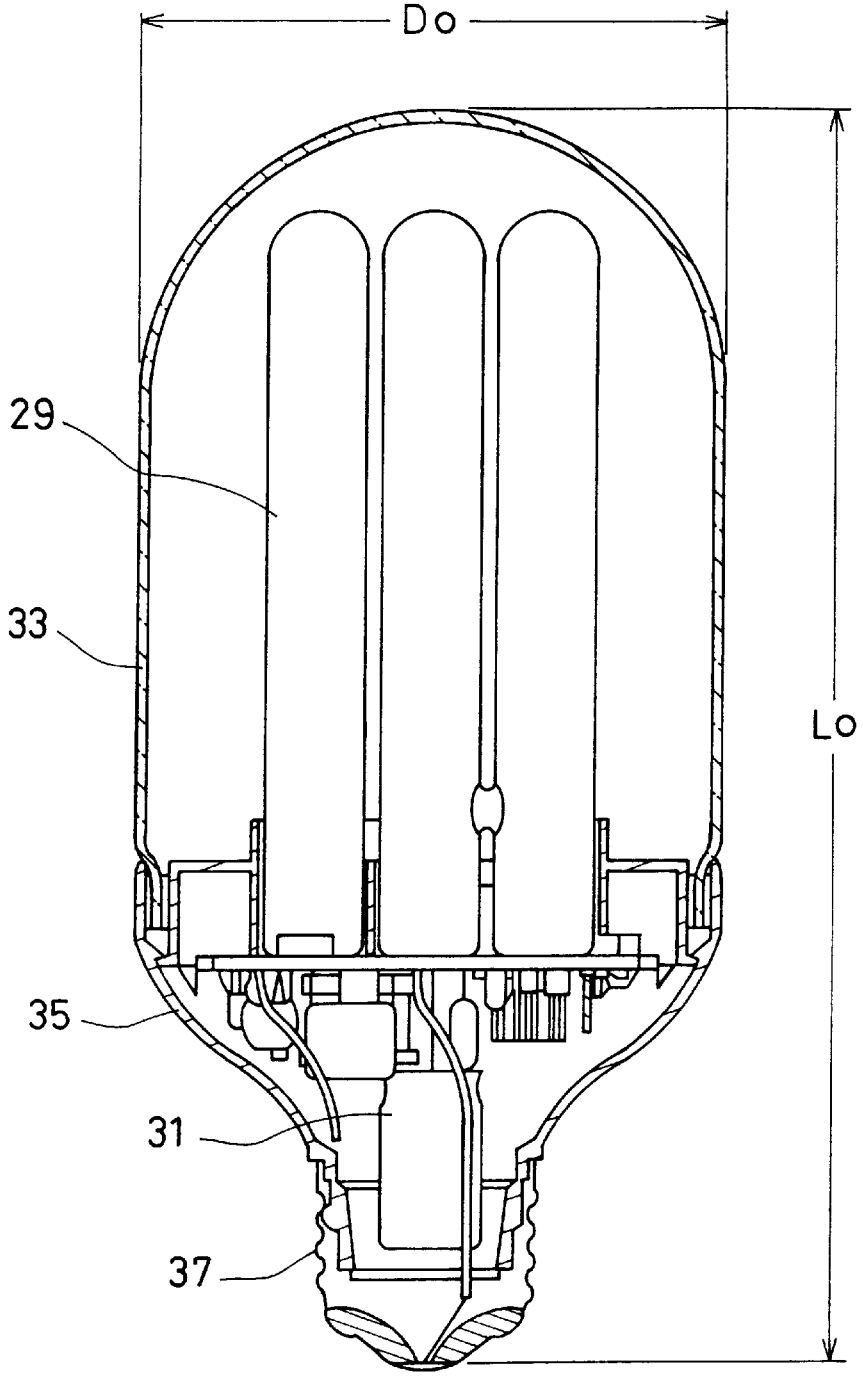
FIG. 10(PRIOR ART)
FIG. 10 is a partially cutaway front view of a self-ballasted fluorescent lamp provided with a conventional cylndrical outer bulb.

FIG. 8 shows the relationship between the maximum temperature Tm of the PC resin substrate 27 and the distance Lp. The maximum temperature Tm was measured by lighting the lamp in an open type light fixture for a 100 W incandescent lamp at room temperature of 25° C. FIG. 8 indicates that the maximum temperature Tm of the PC resin substrate 27 is decreased at a ratio of about 0.8 to 1.2° C./mm with increasing distance Lp, and that the standard value of the maximum temperature Tm of not more than 130° C. requires that the distance Lp is at least 25 mm. Such a significant change of the maximum temperature Tm with respect to the distance Lp is caused by the facts that (i) the power consumption at the electrodes 12 and 13 is about 2.5 W, which corresponds to about 12% of 22 W of the total power consumption of the lamp, and (ii) the electrodes 12 and 13 where such power is consumed locally are near the PC resin substrate 27. The distance Lp is preferably more than 25 mm for tolerance in order to ensure the lifetime of 6000 hours under severe conditions in practical use. On the other hand, there are restrictions in lengthening the distance Lp in view of an object of the present invention, which is to achieve a small lamp size. The results of the research determined that a preferable distance Lp is in the range from 25 mm to 40 mm. In other words, this range can keep the maximum temperature of the PC resin substrate 27 at not more than 130° C. of the standard value and can achieve a small lamp size.

In order to lengthen the distance Lp between the tungsten coil electrodes 12 and 13 and the PC resin substrate 27, either one of or both (i) the distance Lp1 between the tube end portion of the fluorescent tube 1 and the PC resin substrate 27 and (ii) the distance Lp2 between the tube end portion of the fluorescent tube 1 and the tungsten coil electrodes 12 and 13 can be adjusted. However, in the practical lamp design, it is preferable to adjust both the distances Lp1 and Lp2.

Based on the above-described results, a lamp having a distance Lp of 32 mm, in addition to the lamp size and the size of the fluorescent tube as described above, was produced as a typical lamp that eventually fulfills the objects of the present invention. Then, it was confirmed that both the fluorescent tube 1 and the electronic ballast circuit portion 23 of this lamp operate normally for 6000 hours or more.

As described above, when the size of the lamp and the fluorescent tube and the operation lamp current are set in appropriate ranges, the lamp is even more compact so that the light fixture application ratio is improved. In addition, this lamp is a high wattage self-ballasted fluorescent lamp having a lifetime of 6000 hours and a high lamp efficiency of 66 lm/W.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A self-ballasted fluorescent lamp comprising a fluorescent tube comprising a pair of electrodes inside, an electronic ballast circuit portion, an outer bulb, a resin case and a lamp base, wherein (i) the outer bulb has an outer diameter of 60 mm to 70 mm, an outer diameter of a bottom portion of 50 mm to 58 mm, and a total length of 73 mm to 85 mm, (ii) the resin case has an outer diameter of 50 mm to 58 mm, (iii) a total length of the self-ballasted fluorescent lamp is not more than 148 mm, and the fluorescent tube has a distance between the electrodes of 450 mm to 540 mm and an inner diameter of 8.0 mm to 10.0 mm, and is operated at a lamp current of not more than 220 mA.

2. The self-ballasted fluorescent lamp according to claim 1, wherein a distance between the electrodes of the fluorescent tube and a PC resin substrate of the electronic ballast circuit portion is 25 mm to 40 mm.

3. The self-ballasted fluorescent lamp according to claim 1, wherein a buffer gas enclosed in the fluorescent tube is based on a mixed gas of Ne and Ar, where a composition ratio of Ne is not more than 75%.

4. The self-ballasted fluorescent lamp according to claim 1, wherein the fluorescent tube is obtained by integrating four U-shaped glass tubes into one tube.

5. The self-ballasted fluorescent lamp according to claim 1, which is operated at a lamp current of not more than 210 mA.

* * * * *